US008250962B1

(12) United States Patent
Guenther et al.

(10) Patent No.: US 8,250,962 B1
(45) Date of Patent: Aug. 28, 2012

(54) BULLET VELOCITY ENHANCING RIFLE ATTACHMENT ASSEMBLY

(76) Inventors: Isaac Guenther, Seminole, TX (US); Tina Guenther, Seminole, TX (US)

( * ) Notice: Subject to any disclaimer, the term of this patent is extended or adjusted under 35 U.S.C. 154(b) by 197 days.

(21) Appl. No.: 12/813,629

(22) Filed: Jun. 11, 2010

(51) Int. Cl.
*F41A 21/00* (2006.01)

(52) U.S. Cl. ..... 89/14.3; 42/79; 42/77; 42/107

(58) Field of Classification Search ..... 89/14.05, 89/14.3; 42/79, 77, 107
See application file for complete search history.

(56) References Cited

U.S. PATENT DOCUMENTS

| | | | | | |
|---|---|---|---|---|---|
| 1,939,700 | A | * | 12/1933 | Hofstetter | 89/14.2 |
| 2,075,837 | A | * | 4/1937 | Studler | 89/14.5 |
| 2,150,161 | A | * | 3/1939 | Green | 89/14.3 |
| 3,707,899 | A | * | 1/1973 | Perrine | 89/14.3 |
| 4,058,925 | A | * | 11/1977 | Linde et al. | 42/79 |
| 4,368,589 | A | * | 1/1983 | A'Costa | 42/77 |
| 4,527,348 | A | * | 7/1985 | Brennan | 42/76.01 |
| 4,579,037 | A | * | 4/1986 | Gillum | 89/180 |
| 4,590,698 | A | * | 5/1986 | Finn | 42/78 |
| 4,681,016 | A | | 7/1987 | Creedon | |
| 4,691,614 | A | * | 9/1987 | Leffel et al. | 89/14.3 |
| 4,813,333 | A | * | 3/1989 | Garris et al. | 89/14.3 |
| 5,097,614 | A | | 3/1992 | Strong | |
| 5,992,291 | A | * | 11/1999 | Widder et al. | 89/14.05 |
| 6,065,384 | A | * | 5/2000 | Widder et al. | 89/14.05 |
| 6,112,447 | A | * | 9/2000 | Androsov | 42/79 |
| 6,302,009 | B1 | * | 10/2001 | O'Quinn et al. | 89/14.4 |
| D592,271 | S | | 5/2009 | Salva | |
| 2003/0024377 | A1 | | 2/2003 | Diller | |
| 2003/0154849 | A1 | | 8/2003 | Breuer | |

* cited by examiner

*Primary Examiner* — Michael Carone
*Assistant Examiner* — Samir Abdosh

(57) ABSTRACT

A bullet velocity enhancing rifle attachment assembly a sleeve having a first end, a second end and a perimeter wall. The sleeve has an aperture therein extending into the first end and outwardly of the second end. The aperture is defined by an inner wall including a first portion adjacent to the first end, an second portion adjacent to the second end and a central portion positioned between the first and second portions. The central portion has an toroidal shape. A coupler attached to the second end of the sleeve is releasably engageable with a gun barrel to align the aperture with the gun barrel. Pressure from a front side of a bullet traveling down the gun barrel is forced into the central portion to travel around the toroidal shape and back into the aperture toward the first portion, behind the bullet, as the bullet travels through the central portion.

4 Claims, 5 Drawing Sheets

BULLET VELOCITY ENHANCING RIFLE ATTACHMENT ASSEMBLY

BACKGROUND OF THE DISCLOSURE

Field of the Disclosure

The disclosure relates to bullet velocity enhancing devices and more particularly pertains to a new bullet velocity enhancing device for increasing the speed of a bullet by utilizing the force of a bullet's pressure wave.

SUMMARY OF THE DISCLOSURE

An embodiment of the disclosure meets the needs presented above by generally comprising a sleeve has a first end, a second end and a perimeter wall extending between the first and second ends. The sleeve has an aperture therein extending into the first end and outwardly of the second end. The aperture is defined by an inner wall including a first portion adjacent to the first end, an second portion adjacent to the second end and a central portion positioned between the first and second portions. The first and second portions have a cylindrical shape. The central portion has an toroidal shape extending around an axis of the aperture. The toroidal shape has a distal edge and a proximal edge with respect to the first end. A coupler is attached to the second end of the sleeve. The coupler is releasably engageable with a gun barrel to align the aperture with the gun barrel. Pressure from a front side of a bullet traveling down the gun barrel is forced into the central portion to travel from the proximal edge to the distal edge and back into the aperture toward the first portion as the bullet travels through the central portion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
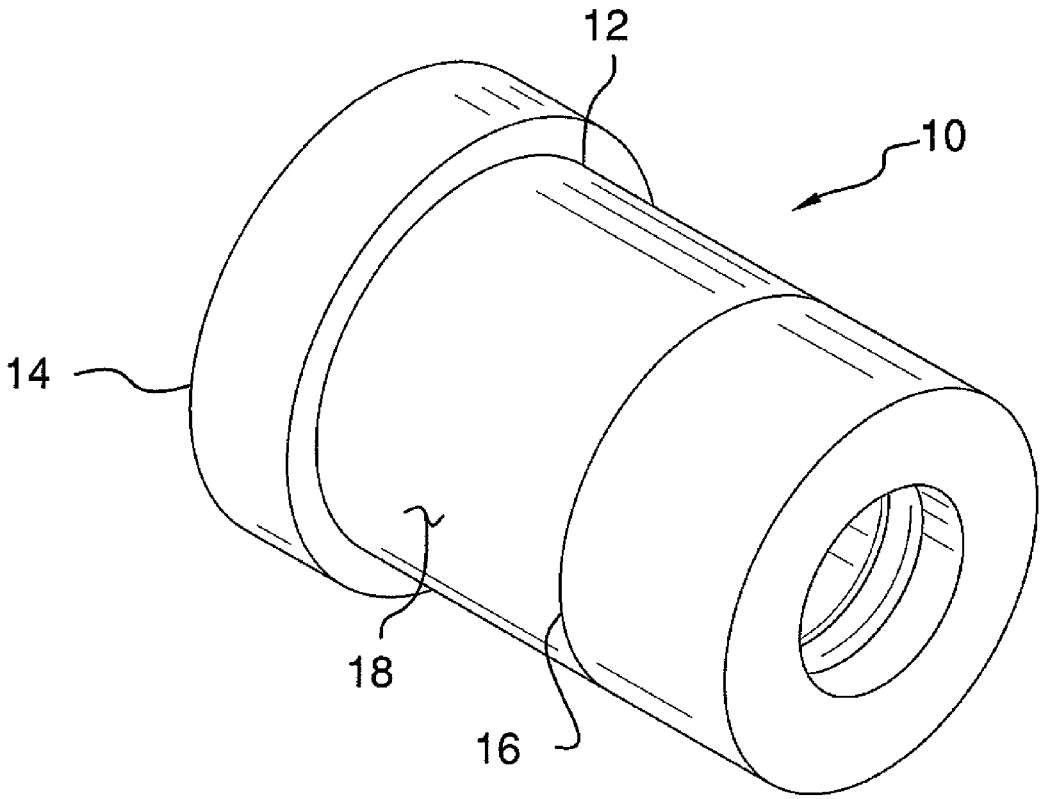
FIG. 1 is a rear perspective view of a bullet velocity enhancing rifle attachment assembly according to an embodiment of the disclosure.
Figure 2:
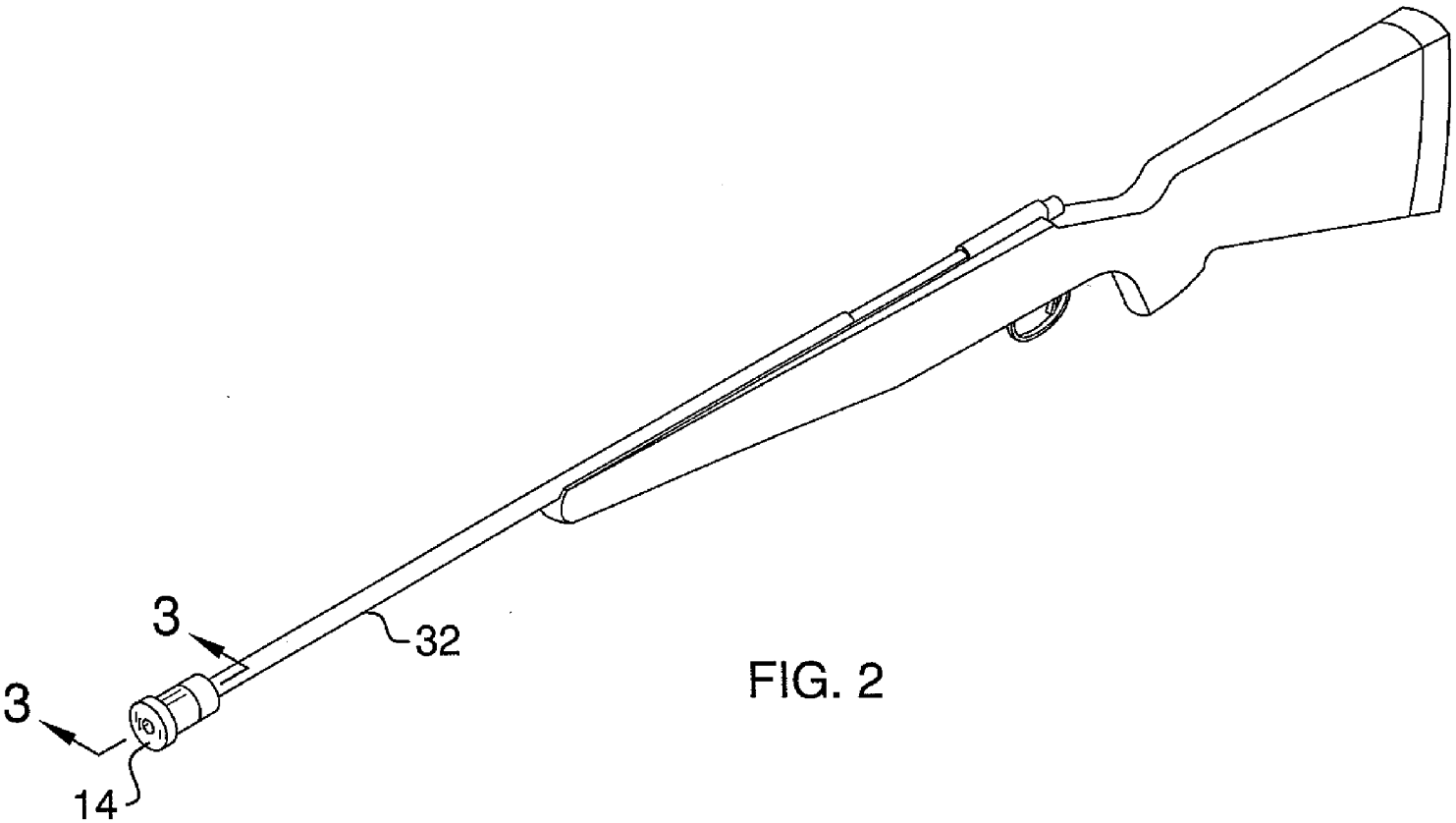
FIG. 2 is an in-use front perspective view of an embodiment of the disclosure.

With reference now to the drawings, and in particular to FIGS. 1 through 4 thereof, a new bullet velocity enhancing device embodying the principles and concepts of an embodiment of the disclosure and generally designated by the reference numeral 10 will be described.

As best illustrated in FIGS. 1 through 4, the bullet velocity enhancing rifle attachment assembly 10 generally comprises a sleeve 12 that has a first end 14, a second end 16 and a perimeter wall 18 extending between the first 14 and second 16 ends. The sleeve 12 has an aperture 20 therein extending into the first end 14 and outwardly of the second end 16. The aperture 20 is defined by an inner wall. The inner wall includes a first portion 22 adjacent to the first end 14, a second portion 24 adjacent to the second end 16 and a central portion 26 positioned between the first 22 and second 24 portions. The first 22 and second 24 portions have a cylindrical shape. The central portion 26 has an oblong toroidal shape, or cutout, extending around an axis of the aperture 20. The central section 15 has a cross-section taken parallel to the axis of the aperture 20 forming a pair of obrounds having curved ends and straight edges extending between the curved ends. The obrounds, or the toroidal shape as a whole, have a distal edge 28 and a proximal edge 30 with respect to the first end 14.

Figure 3A:
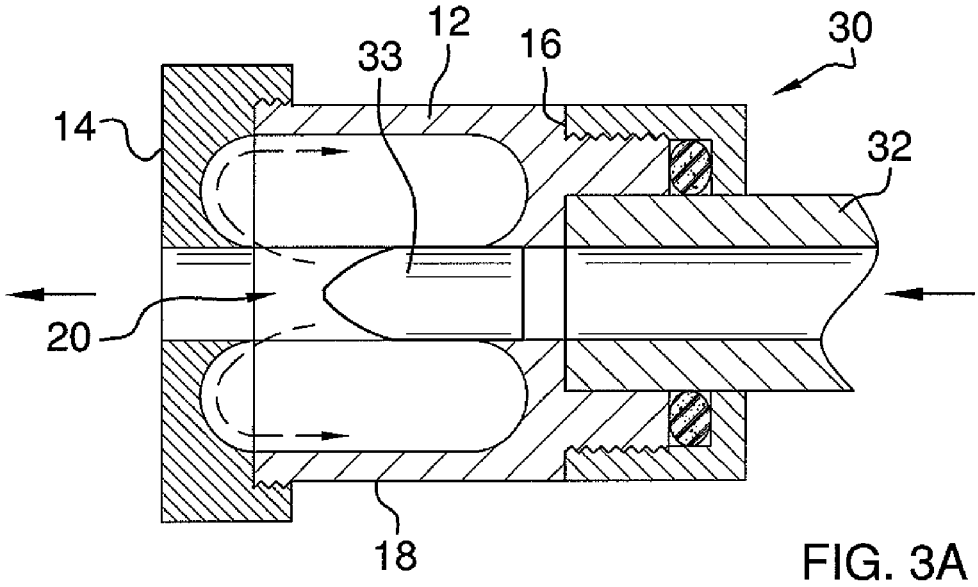
FIG. 3A is a cross-sectional view of an embodiment of the disclosure taken along line 3-3 of FIG. 2.
Figure 3B:
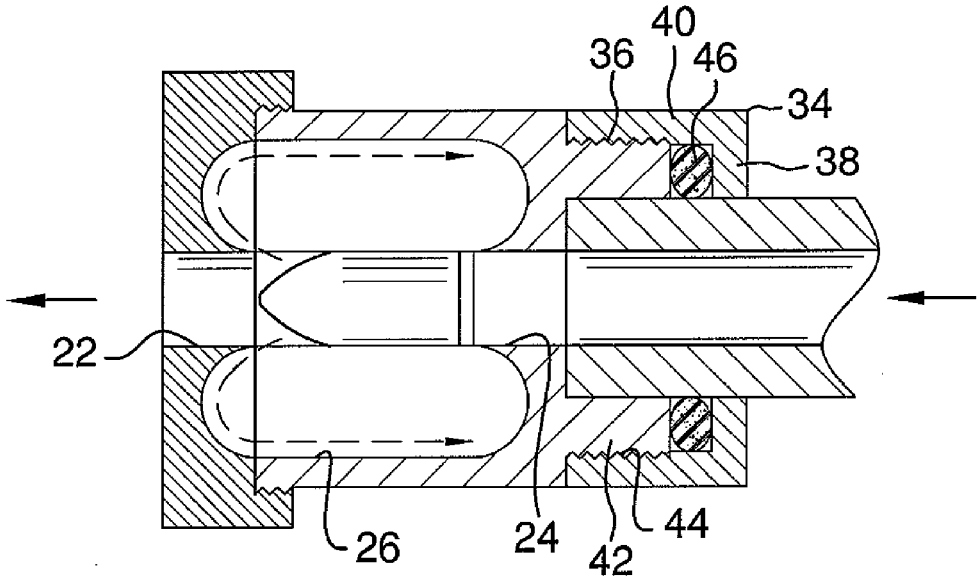
FIG. 3B is a cross-sectional view of an embodiment of the disclosure.

A coupler 30 is attached to the second end 16 of the sleeve 12. The coupler 30 is releasably engageable with a gun barrel 32 to align the aperture 20 with the gun barrel 32. As shown in the Figures, the coupler 30 may take a variety of forms. FIG. 3A shows a coupler 30 including a housing 34 positioned on the barrel 32 having an inner threading 36. The housing 34 has an end wall 38 and a peripheral wall 40 extending away from the end wall 38. The barrel 32 is extended through the end wall 38. A male coupler 42 having threading 44 thereon is attached to the second end 16 and engages the inner threading 36 positioned on the peripheral wall 40. An elastomeric washer 46 is urged against the end wall 38, causing it to expand toward and frictionally engage the barrel 32 to hold the sleeve 12 to the barrel 32. FIG. 3D shows a barrel 32 having outer threading 48 thereon. A female coupler 50 is attached to the second end 16 and threadably engages the outer threading 48.

Figure 3C:
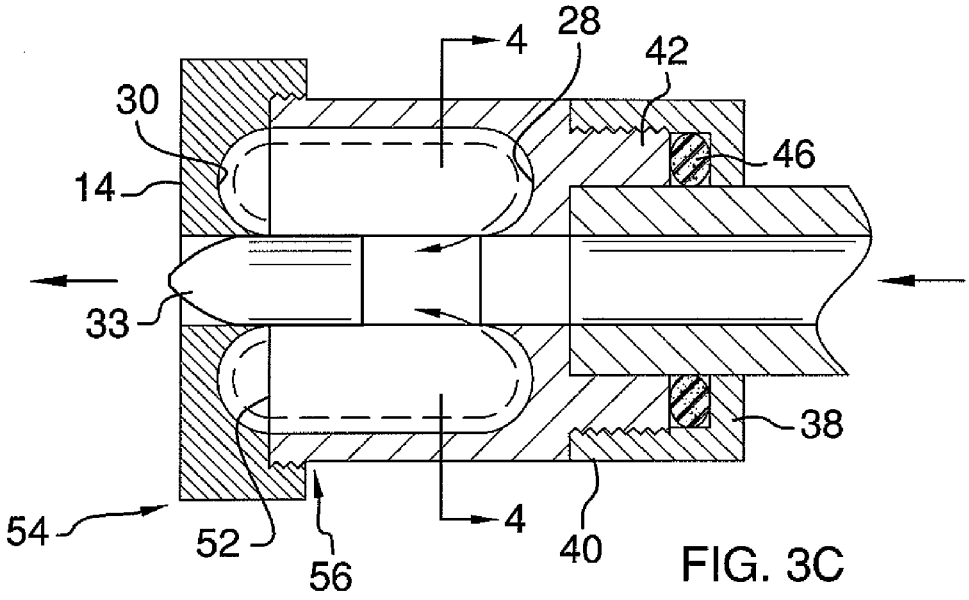
FIG. 3C is a cross-sectional view of an embodiment of the disclosure.
Figure 3D:
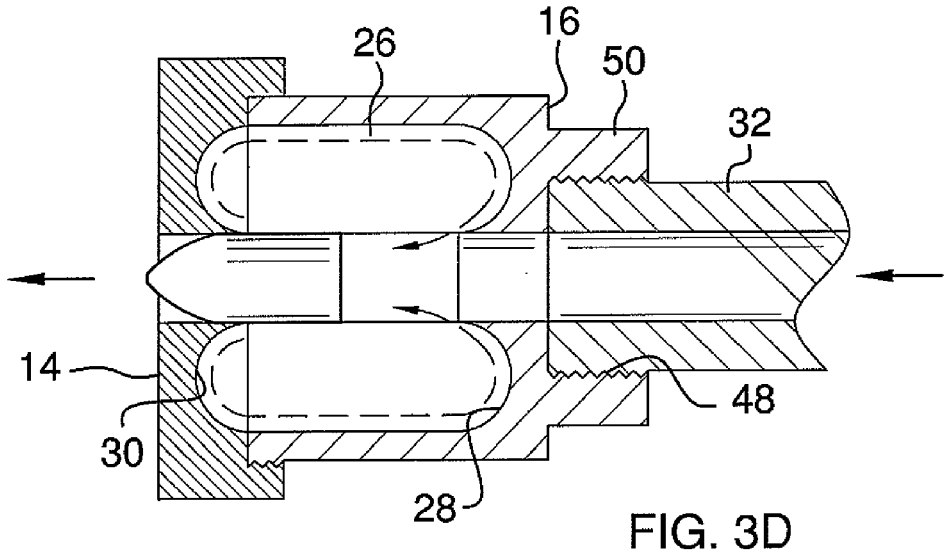
FIG. 3D is a cross-sectional view of an embodiment of the disclosure depicting another coupler of the invention.
Figure 4:
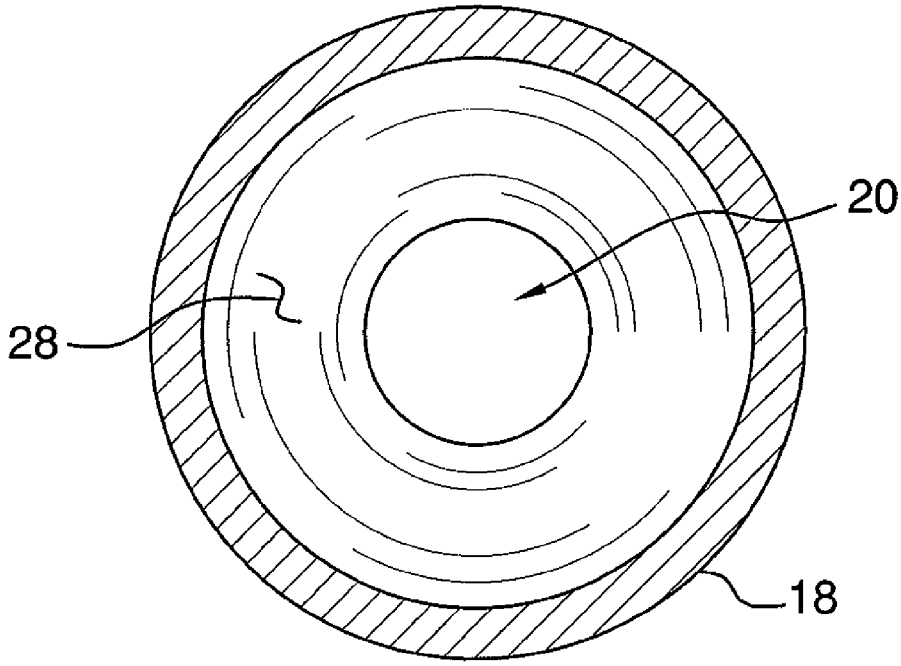
FIG. 4 is a cross-sectional view of an embodiment of the disclosure taken along line 4-4 of FIG. 3C.

As shown in FIG. 3C, the sleeve 12 may have a break 52 therein positioned at a juncture of the first 22 and central 26 portions to define a first section 54 and a second section 56 of the sleeve 12. Because of the shape of the toroid, the proximal edge 30 extends into a portion of the sleeve 12 containing the first portion 22 such that the break extends through the toroid. The first 54 and second 56 sections are threadably coupled together. By removing the first section 54 from the second section 56, the user of the assembly 10 can access and clean the toroidal shape.

In use, a bullet 33 is fired from a rifle barrel 32 in a conventional manner to send the bullet 33 down the barrel 32. The bullet 33 creates a pressure wave in front of it. As the front side of the bullet 33 travels into the sleeve 12, the pressure wave (as shown by the arrows within the central portion 26) is forced into the central portion 26 to travel from the proximal edge 30 to the distal edge 28 and back into the aperture 20 toward the first portion 22 as the bullet 33 travels through the central portion 26. This pressure, reintroduced behind the bullet 33, will add force to the bullet 33 and increase its velocity.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A bullet velocity enhancing assembly being attachable to a gun barrel, said assembly including:

a sleeve having a first end, a second end and a perimeter wall extending between said first and second ends, said sleeve having an aperture therein extending into said first end and outwardly of said second end, said aperture being defined by an inner wall, said inner wall including a first portion adjacent to said first end, an second portion adjacent to said second end and a central portion positioned between said first and second portions, said first and second portions having a cylindrical shape, said central portion having an toroidal shape extending across its length and around an axis of said aperture, said toroidal shape having a distal edge and a proximal edge with respect to said first end;

a coupler being attached to said second end of said sleeve, said coupler being releasably engageable with a gun barrel to align said aperture with said gun barrel; and wherein pressure from a front side of a bullet traveling down the gun barrel is forced into said central portion to travel from said proximal edge to said distal edge and back into said aperture toward said first portion as the bullet travels through said central portion.

2. The assembly according to clam 1, wherein said toroidal shape is oblong such that said central section has a cross-section taken parallel to said axis of said aperture forming a pair of obrounds.

3. The assembly according to clam 1, wherein said sleeve has a break therein positioned at a juncture of said first and central portions to define a first section and a second section of said sleeve, said first and second sections being threadably coupled together.

4. A bullet velocity enhancing assembly being attachable to a gun barrel, said assembly including:

a sleeve having a first end, a second end and a perimeter wall extending between said first and second ends, said sleeve having an aperture therein extending into said first end and outwardly of said second end, said aperture being defined by an inner wall, said inner wall including a first portion adjacent to said first end, an second portion adjacent to said second end and a central portion positioned between said first and second portions, said first and second portions having a cylindrical shape, said central portion having an oblong toroidal shape across its length and extending around an axis of said aperture such that said central section has a cross-section taken parallel to said axis of said aperture forming a pair of obrounds, said obrounds having a distal edge and a proximal edge with respect to said first end;

a coupler being attached to said second end of said sleeve, said coupler being releasably engageable with a gun barrel to align said aperture with said gun barrel, wherein pressure from a front side of a bullet traveling down the gun barrel is forced into said central portion to travel from said proximal edge to said distal edge and back into said aperture toward said first portion as the bullet travels through said central portion; and said sleeve having a break therein positioned at a juncture of said first and central portions to define a first section and a second section of said sleeve, said first and second sections being threadably coupled together.

* * * * *